US010427203B2

(12) United States Patent
Charles

(10) Patent No.: US 10,427,203 B2
(45) Date of Patent: Oct. 1, 2019

(54) TRANSFER PRESS SPLIT IDLE STATION LOCKING MECHANISM

(71) Applicant: Toyota Motor Engineering & Manufacturing North America, Inc., Erlanger, KY (US)

(72) Inventor: Thoney R. Charles, Georgetown, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 403 days.

(21) Appl. No.: 15/455,543

(22) Filed: Mar. 10, 2017

(65) Prior Publication Data

US 2018/0257125 A1 Sep. 13, 2018

(51) Int. Cl.
*B21D 43/04* (2006.01)
*B21D 43/05* (2006.01)
*B21D 43/00* (2006.01)

(52) U.S. Cl.
CPC ..... *B21D 43/057* (2013.01); *B21D 43/00* (2013.01); *B21D 43/04* (2013.01); *B21D 43/055* (2013.01)

(58) Field of Classification Search
CPC ..... B21D 43/057; B21D 43/00; B21D 43/04; B21D 43/055
USPC ..... 72/405.09
See application file for complete search history.

(56) References Cited

U.S. PATENT DOCUMENTS

| | | | | |
|---|---|---|---|---|
| 4,089,203 | A * | 5/1978 | Wallis | B21D 43/055 198/742 |
| 4,503,969 | A | 3/1985 | Baba | |
| 4,557,370 | A | 12/1985 | Tanaka | |
| 4,614,265 | A | 9/1986 | Glasberg | |
| 7,690,238 | B2 * | 4/2010 | Shiroza | B21D 43/055 72/405.11 |
| 8,925,363 | B2 | 1/2015 | Charles | |
| 2015/0239194 | A1 * | 8/2015 | Charles | B30B 15/30 700/114 |
| 2018/0200777 | A1 * | 7/2018 | Kinniard | B21D 43/057 |
| 2018/0257125 | A1 * | 9/2018 | Charles | B21D 43/057 |

* cited by examiner

*Primary Examiner* — David B Jones
(74) *Attorney, Agent, or Firm* — Dinsmore & Shohl LLP

(57) ABSTRACT

A split idle station assembly, a transfer press assembly including a split idle station assembly and a method of operating an idle station for a transfer press assembly. The split idle station includes numerous workpiece mounting brackets that are insertable into corresponding parts of a multi-component movable base assembly such that upon moving from a split configuration into a support configuration, a locking mechanism cooperates with base assembly parts and mounting brackets to form a locking interference fit or engagement for each mounting bracket in order to securely support a workpiece on the brackets. Likewise, the cooperative movement of the first and second base assembly sections away from one another causes a release the interference fit from the notch to effect disengagement of the locking mechanism. The construction of the locking mechanism is such that both the engagement and disengagement may be performed as part of a one-handed operation.

20 Claims, 6 Drawing Sheets

TRANSFER PRESS SPLIT IDLE STATION LOCKING MECHANISM

TECHNICAL FIELD

The present specification relates generally to transfer press assemblies and, more particularly, to an idle station for a transfer press assembly that has improved user ergonomics through easier locking and unlocking of components that are selectively secured to the idle station.

BACKGROUND

Transfer presses are generally used in metal-stamping operations and in particular for deep-drawn metal forming operations. Such a press typically includes numerous sequentially-arranged stations each of which receives and transfers a metal blank as it is being successively formed into its desired shape along numerous die (that is to say, working) stations.

Typically, the transfer press includes one or more idle stations situated between the successive punch-and-die stations as a way to provide locating and positioning functions for the workpiece being formed. Because the workpiece may be of different sizes or shapes, it is beneficial to provide the idle stations with the ability to accurately and adaptively support, position and locate such pieces, regardless of their size or shape. One conventional way to achieve this is to have the workpiece-holding portion of the idle station be of divided construction so that they can be split laterally (i.e., sideways) relative to the direction of travel of the workpiece as it traverses the transfer press. During such splitting, an operator unhooks a hinged, spring loaded handle from a retainer and pulls one half of the part-holding portion of the idle station toward him or her, while the other half moves in an opposing direction via cable or related linkage. Idle stations configured to have such divided construction are known as split idle stations.

In conventional design, various locking schemes are used to keep split idle station components temporarily in place. In one known form as shown in FIG. 2, such locking is used to keep a workpiece-holding bracket in place during idle station use. Conventionally, when a pin or related protruding mounting part of the bracket is inserted into a complementary-sized and shaped hollow shaft or channel 45 within a holder 40 that includes a handle 41, biasing spring 42 and lever 43 movable about a pivot point 44, the biased construction allows an interference fit to be formed with a circumferentially notched portion that is formed around the periphery of the pin that is inserted along its axial (that is to say, longitudinal) dimension beyond the position within the channel 45 where the lever 43 is located. Details of these various components used in holder 40 are shown by removing cover 46 and fasteners 47. While generally useful for their intended purpose, such a locking configuration requires a two-hand operation to release the bracket. For example, an operator of the idle station must use one hand with which to pull on the handle 41 to overcome the spring bias as a way to temporarily unseat the lever 43 from the notch, while the other hand is used to lift the bracket out of engagement with the holder 40. The author of the present disclosure has determined that such two-handed operation is cumbersome, and that a simplified approach to connecting and disconnecting a workpiece-holding bracket is warranted.

SUMMARY

In one embodiment, a split idle station for a transfer press is disclosed. The station includes a track assembly, a drive assembly, numerous workpiece mounting brackets and a locking mechanism. The drive assembly cooperates with the track assembly such that numerous base assembly sections may be moved along an elongate dimension of the track assembly. The base assembly includes a vertically-extending channel that terminates in an aperture defined in at least its upper surface. The base assembly also includes a horizontally-extending channel that terminates in an aperture defined in at least one of each base assembly's side surface. The penetration of the vertical and horizontal channels into a body of each base assembly is such that the channels intersect to define a common volumetric space within. Movement of the base assembly sections extends between a first position where the base assembly sections (and hence, the idle station) define a split configuration, and a second position where the base assembly sections define a support configuration. Workpiece mounting brackets—such as those used to provide mounting ore related support to a part being operated upon by the transfer press and idle station—each include a pin that extends in a substantially vertical downward direction such that each mounting bracket may be selectively received on a respective one of the base assembly sections through at least the cooperation of the pin and the vertically-extending channel. The locking mechanism includes a stationary rod and a notch formed in the pin of each of the workpiece mounting brackets, and is constructed such that when each of the workpiece mounting brackets is received on the respective one of the base assembly sections, the size, shape and placement of the pin and rod are such that the cooperative movement of the base assembly sections toward one another causes a portion of the rod to extend into the volumetric space that is occupied by the notch to form an interference fit between the rod and the notch portion of the pin to effect engagement of the locking mechanism. Likewise, the cooperative movement of the first and second base assembly sections away from one another causes the rod to release the interference fit from the notch to effect disengagement of the locking mechanism.

In another embodiment, a transfer press assembly is disclosed. The transfer press assembly includes a first work station, a second work station, a transfer feed assembly that transfers a workpiece from the first work station to the second work station and a split idle station assembly disposed between the first work station and the second work station, where the split idle station assembly includes a track assembly, a drive assembly, numerous workpiece mounting brackets and a locking mechanism in a manner as discussed above in conjunction with the previous embodiment.

In yet another embodiment, a method of operating on a workpiece in a transfer press assembly is disclosed. The method includes arranging the idle station to be adjustable between a support configuration and a split configuration by placing one or more workpiece mounting brackets on corresponding assemblies such that a pin that extends in a substantially vertical downward direction from each mounting bracket is received into a vertical channel that extends into the corresponding one of the base assembly sections, and then moving the base assembly sections toward one another along track assembly portion of the idle station such that a locking mechanism engages to secure the mounting bracket to the corresponding one of the base assembly sections. The construction of the idle station (which includes a track assembly, a drive assembly, a handle and a coupling) is such that the use of the locking mechanism to engage each mounting bracket to its respective base assembly is achieved solely by virtue of the attainment of a workpiece-support configuration that arises from the movement of the base assembly sections toward one another. The locking mechanism includes a stationary rod secured to the track assembly such that during locking mechanism engagement, the rod forms an interference fit with a notch formed in the pin when the two are brought together a common volumetric space that is formed by the intersection of horizontal and vertical channels within each base assembly.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein relate to a locking mechanism used in a split idle station of a transfer press assembly where the motion of the idle station automatically locks and unlocks a pair of removable brackets that act as a secure mounting location for a workpiece that is being formed in one or more work stations of the transfer press. In particular, when the brackets are brought closer together from a split position into a workpiece support position due to the simultaneous inward movement of a pair of bracket holders, a generally horizontal stationary rod with its elongate dimension aligned along the direction of bracket and holder movement is accepted into a complementary-sized channel that is formed in the bracket holders. Prior to such inward movement of the brackets, the idle station operator places a pin-shaped mount that is rigidly formed on a vertically-downward side of the bracket into a generally vertically-extending and complementary-sized channel within the bracket that partially intersects the generally horizontal channel of in an orthogonal manner so that there is an offset overlap between the two channels. Likewise, a groove formed about the periphery of the pin-shaped mount is sized so that when this portion of the pin is inserted through the vertical channel to the point where the groove is substantially aligned with the horizontal channel, the cross-sectional area of the portion of the rod that passes through the horizontal channel fits within the groove. In this way, an idle station operator may mount the brackets into their respective bracket holders with single-handed movement by dropping the pin of the bracket into the vertical aperture of the portion of the base assembly in order to lock the workpiece-holding brackets in place.

Figure 1:
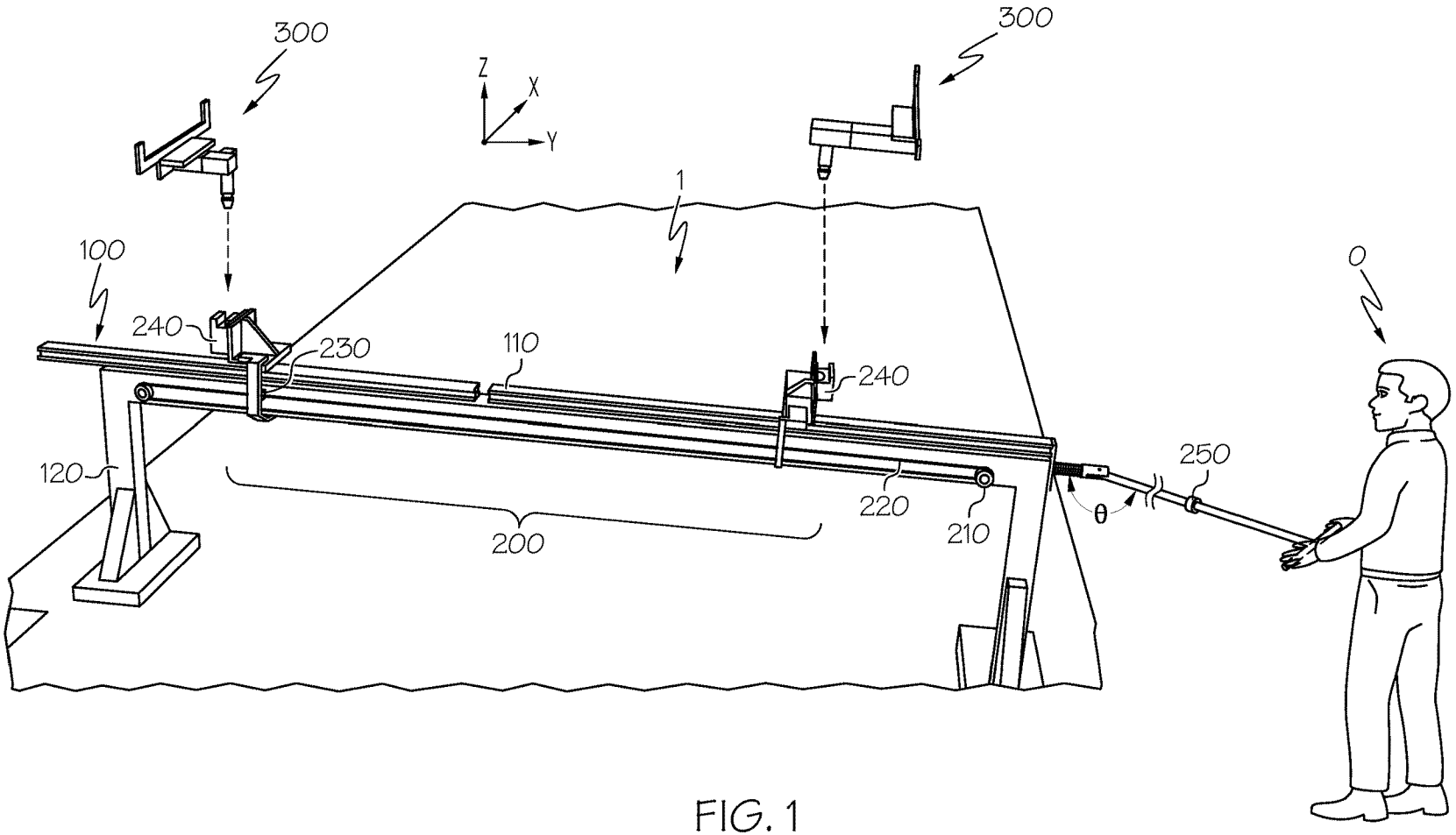
FIG. 1 depicts a perspective view of a split idle station assembly in accordance with one or more embodiments shown or described herein.
Figure 2:
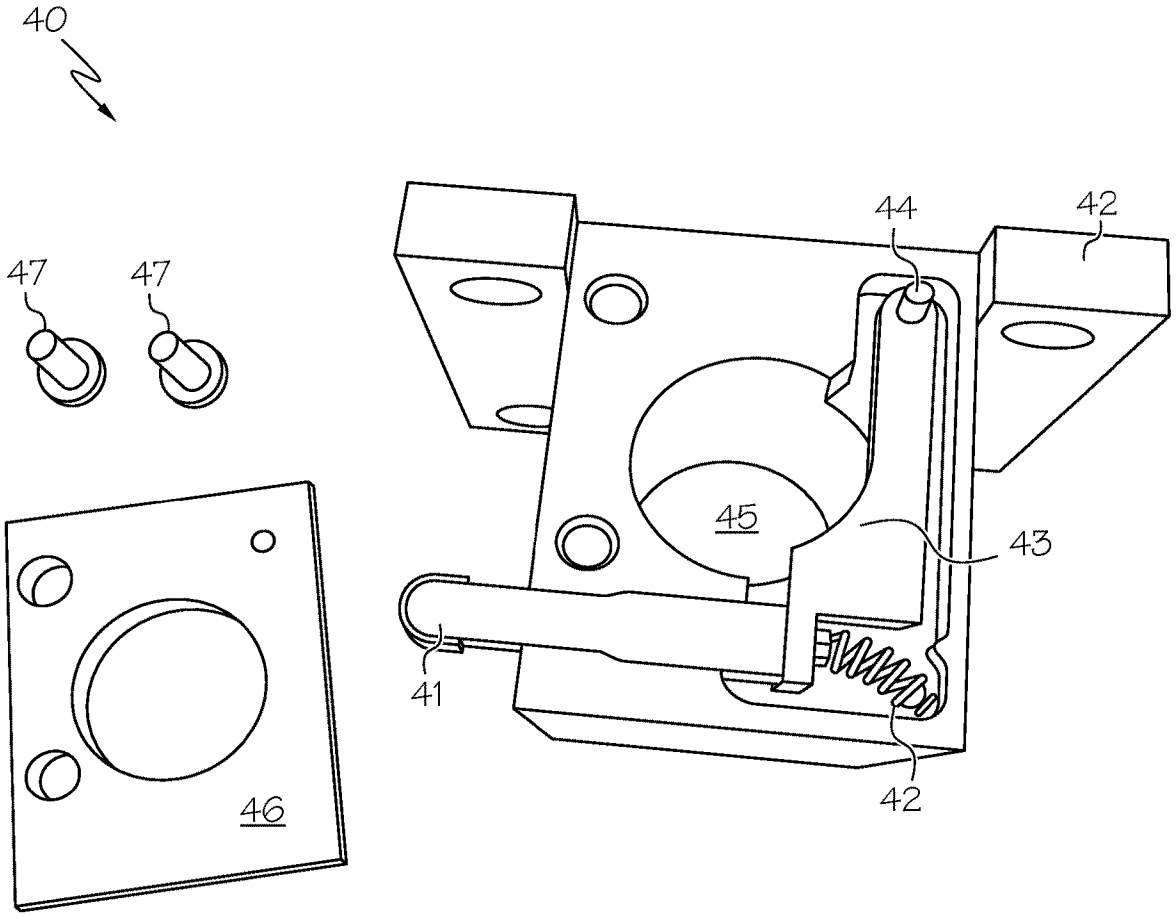
FIG. 2 (PRIOR ART)
FIG. 2 depicts a bracket holder art in a partially disassembled state to show how the spring-biased lever is used to selectively engage a pin-shaped mount according to the prior art.

Referring first to FIG. 1, a split idle station assembly 1 is shown in isolation, where adjacent parts of a surrounding transfer press assembly work stations have been removed for clarity. Thus, although not shown, it will be understood that such a transfer press assembly includes a feed assembly that is configured to deliver a workpiece (not shown) between numerous work stations that may include one or more inline presses that can perform various portions of an overall forming process, such as drawing, trimming, bending, piercing, stamping or the like. Details associated with such a transfer press assembly may be found in U.S. Pat. No. 8,925,363 that is owned by the assignee of the present disclosure, and which is hereby incorporated by reference. In fact, the split idle station assembly 1 is sized and located between a pair of adjacent work stations to allow manipulation of such a workpiece. Additionally, while only one split idle station assembly 1 is shown for illustrative purposes, it will be appreciated that any number of split idle station assemblies 1 (as well as corresponding transfer press assembly work stations) can be employed, and that all such variants are within the scope of the present disclosure.

The split idle station assembly 1 includes a rail-based track assembly 100, a drive assembly 200 and movable workpiece holders in the form of brackets 300. The track assembly 100 is formed as a generally elongate rail 110 that is mounted to a frame 120 and extends orthogonally (that is to say, laterally) relative to the travel direction of a workpiece (not shown) as it traverses the various work stations of the transfer press assembly. The construction of the track assembly 100 permits movement of a base assembly 240) that is part of the drive assembly 200 and secured to the rail 110 in a sliding or rolling relationship such that the base assembly 240 travels toward and away from each other during operator O adjustment between corresponding support and split configurations. Although the base assembly is labeled collectively as 240 and the mounting brackets as 300 collectively in FIG. 1, they will in general be referred to individually as 240A and 240B (for the base assembly sections) and 300A, 300B (for the respective mounting brackets) in the remainder of the figures, and that corresponding individual labels for various components and subparts thereof will be understood from the context.

The split idle station assembly 1 is shown in space where the Cartesian coordinates include orthogonal directions associated with the traditional length along the X-axis (as shown as part of the X-Y-Z Cartesian coordinates) that generally corresponds to the travel direction of the workpiece between the various work stations. Similarly, the Cartesian coordinates depicted herein extend along the width along the Y-axis (that generally corresponds to the travel direction of the base assembly 240 along the elongate dimension of rail 110) and height along the Z-axis. Within the present context, various assumptions are made as to the placement of the split idle station assembly 1 and accompanying transfer press assembly within a manufacturing environment. In particular, it is assumed that the split idle station assembly 1 is situated on a generally level horizontal surface that corresponds to the plane defined by the X and Y axes. Likewise, component vertical movements and orientations correspond to the dimension defined by the Z axis. As such, reference to a particular component or portion thereof—as well as movement of a component—as being horizontal or vertical will be understood to be within the context of the Cartesian coordinates discussed herein, and that slight deviations from the same due to minor misalignment of the split idle station assembly 1 relative to such spatial reference system are permissible without any loss in generality, and that all such reference to directions with such a system are deemed to be within the scope of the present disclosure.

The drive assembly 200 includes various pulleys 210 pivotably-mounted on frame 120 such that they are on substantially opposing ends of the rail 110. A continuous cable 220 is trained around the pulleys 210, while a pair of cable connect arms 230 that are rigidly secured to the base assembly 240 and clamped to the cable 220 allows the toward or away movement of individual sections 240A, 240B (that will be discussed in more detail in conjunction with FIGS. 3 and 4) based on respective pushing or pulling movement of handle 250. The movement of the cable 220 is such that as it moves about the pulleys 210, it causes similar back-and-forth movement of the cable connect arms 230 that and the rigidly secured base assembly sections 240A and 240B.

Figure 3:
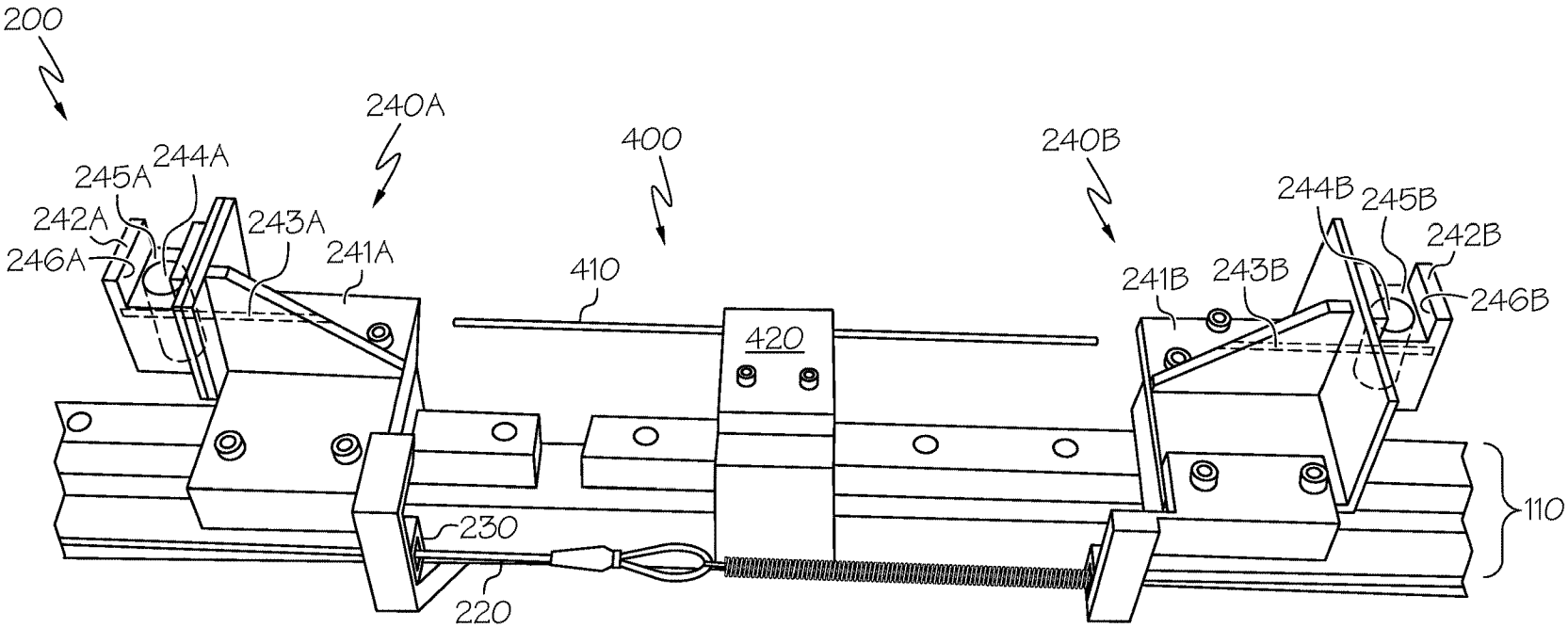
FIG. 3 depicts a detail view of the pair of base assembly sections disposed in a split configuration on a track of the split idle station assembly of FIG. 1.
Figure 4:
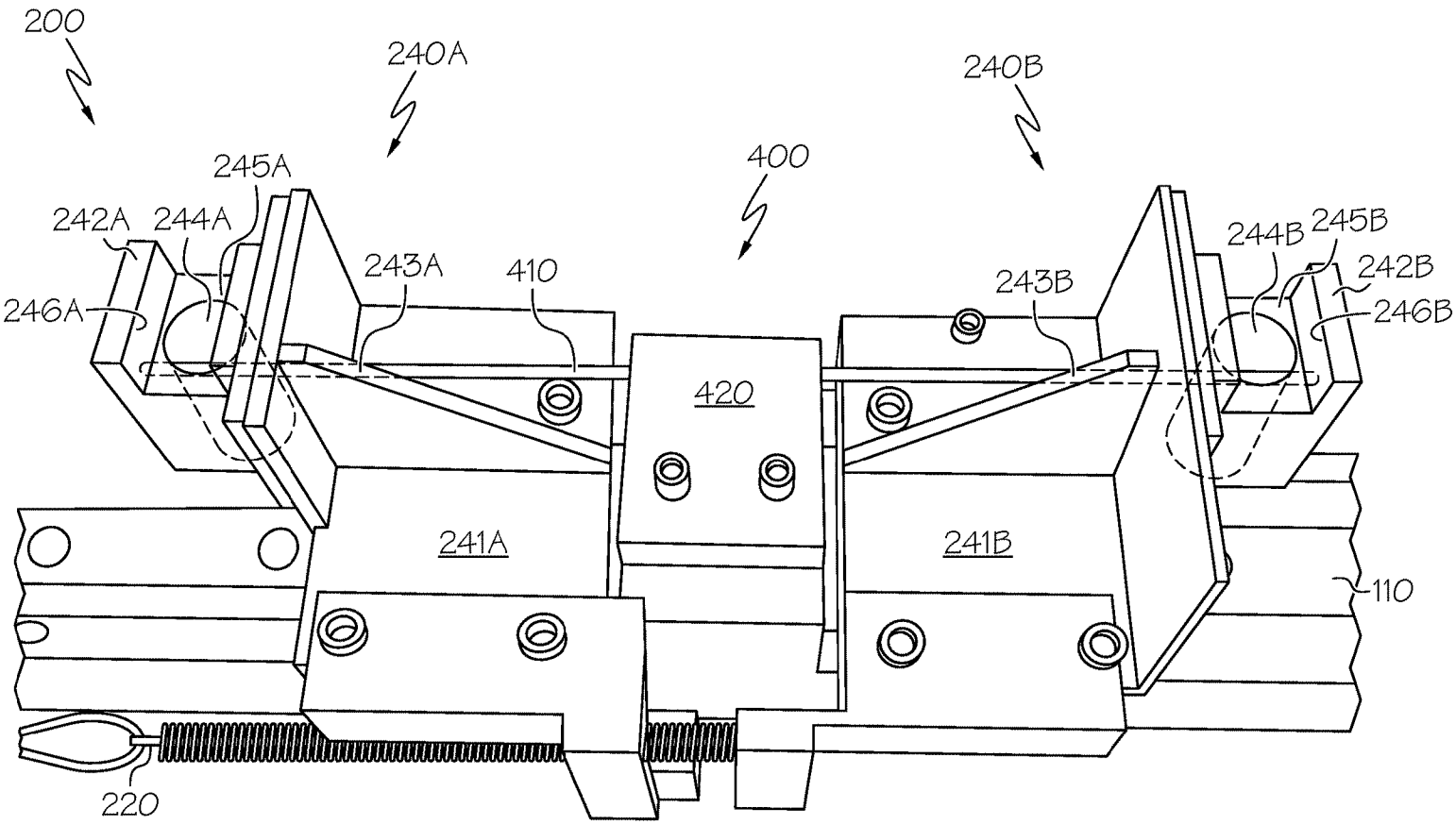
FIG. 4 depicts a detail view of the pair of base assembly sections disposed in a support configuration on a track of the split idle station assembly of FIG. 1.

Referring next to FIGS. 3 and 4, the drive assembly 200 is used in conjunction with a handle 250 such that upon pulling movement of the handle 250 by the operator O, the coupling between the handle and drive assembly 200 moves the first base assembly 240A and the second base assembly 240B away from each other in the split configuration of FIG. 3 Likewise, upon pushing movement of the handle 250 by the operator O, the coupling between the handle and drive assembly 200 moves the first base assembly 240A and the second base assembly 240B toward each other in the support configuration of FIG. 4. In one form, the handle 250 is secured to one or the other of the base assembly sections 240A and 240B (with the latter as shown in FIG. 1). In this way, movement of the secured one of the base assembly sections (for example, base assembly 240B by virtue of it being closest to handle 250) as a result of movement of the handle 250 produces sympathetic movement in the other base assembly 240A. Within the present context, sympathetic movement between the base assembly sections 240A and 240B means that one (for example, base assembly 240A) moves in or out along the rail 110 a common amount with the other (for example, base assembly 240B) depending on how much the movement of the handle 250 causes movement of the other.

In one form, the first and second base assembly sections 240A and 240B are slidably received on the rail 110 with grooves or related cooperative shapes. In such a form, the first and second base assembly sections 240A and 240B can be secured to the rail 110 via wheeled connection such that the base assembly sections 240A and 240B define carriage bodies that include a rotatably-mounted support wheels that are positioned on axles for rolling movement within grooves formed along the elongate dimension of the rail 110. Such support wheels may be passive in that they are not actively driven by a motor or other automated device. In yet another form, bearings may be used to establish the slidable connection between the rail 110 and the first and second base assembly sections 240A and 240B.

In one form, the base assembly sections 240A, 240B may be formed as part of a single, unitary structure, while in another form, the base assembly sections 240A, 240B may be formed from rail-engaging supports 241A and 241B to which separately-attachable bodies 242A and 242B may be secured, such as by screws, rivets or other fasteners, and that either variant is within the scope of the present disclosure. In the former case, each body 242A, 242B is subsumed into the corresponding rail-engaging support 241A, 241B with all of the internal functionality remaining substantially identical to that of the latter case. For example, with either variant the horizontal channels 243A and 243B and vertical channels 244A and 244B are present in order to promote the selective engagement and disengagement of a locking mechanism 400 that includes an elongate rod 410 that is rigidly affixed to a block 420 to ensure that the rod 410 remained stationary. In addition, the rod 410 is oriented relative to the track assembly 100 such that the elongate dimension of the rod 410 is substantially parallel with the rail 110 elongate dimension and substantially collinear with the horizontal channels 243A, 243B. In one form, both the rod 410 and the horizontal channels 243A, 243B define a generally cylindrical (that is to say, axisymmetric) cross-sectional profile and sized such that the inner diameter of the horizontal channels 243A, 243B is slightly greater than the outer diameter of the rod 410 in order to facilitate ease of insertion and linear movement therein. In other forms, the cross-sectional profile of the rod 410 and horizontal channels 243A, 243B need not be axisymmetric, so long as their sizes and shapes are complementary in order to have the rod 410 move along the horizontal channels 243A, 243B between the unlocked position of the split configuration of FIG. 3 and the locked position of the support configuration of FIG. 4.

Figure 5:
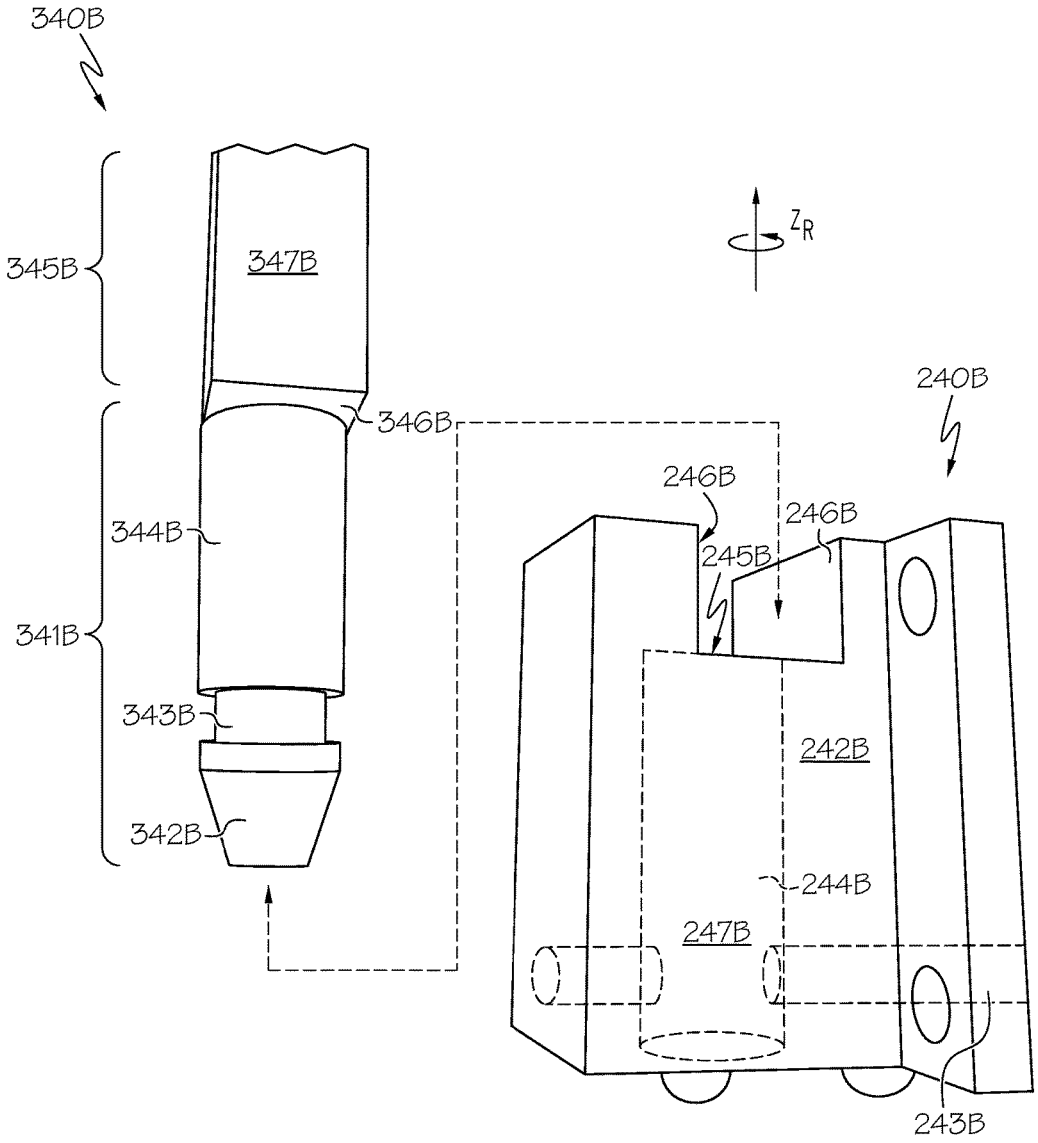
FIG. 5 depicts a first view of the cooperation between a bracket holder and a holder-engaging pin-shaped mount that extends from the bottom of a bracket in accordance with one or more embodiments shown or described herein.
Figure 6:
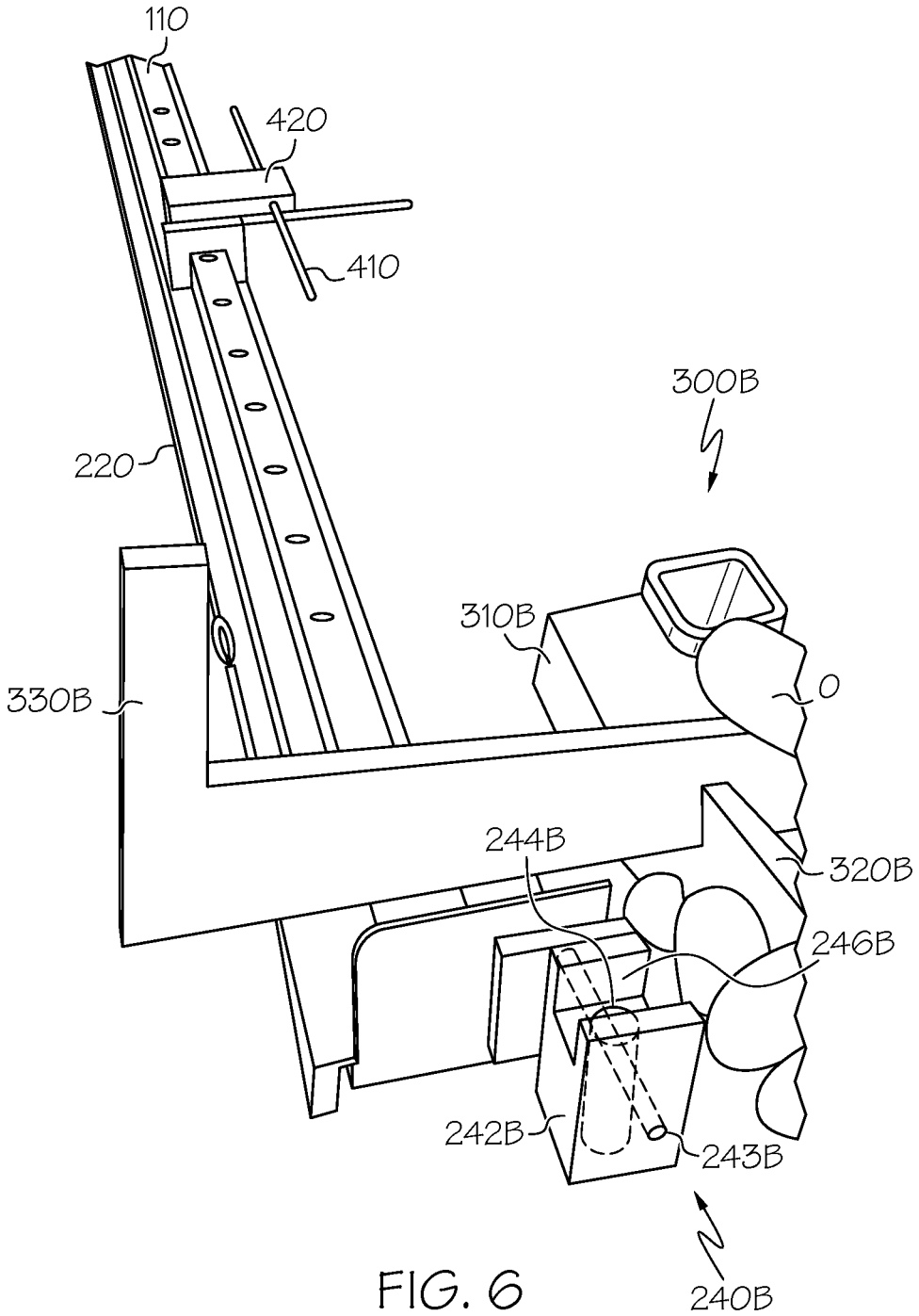
FIG. 6 depicts a view along the longitudinal dimension of the split idle station assembly showing the brackets being held in place on the holder by the locking mechanism and the spring-biased member in accordance with one or more embodiments shown or described herein.

Referring next to FIGS. 5 and 6, an exploded view depicting the interaction of a vertically-downward pin 340B of one of the brackets 300B is shown in FIG. 5, while an operator O-initiated placement of one of the mounting brackets 300B onto one of the base assembly sections 240B is shown in FIG. 6. As shown with particularity in FIG. 6, bracket 300B includes a generally rigid body 310B, hand-grippable shaft 320B and upstanding mounting portion 330B for engagement of a workpiece, while FIG. 5 shows some of the details associated with the vertically downward-extending pin 340B that is used to engage the vertical channel 244B of base assembly 240B and the locking mechanism 400. As with the rod 410 and the horizontal channel, 243B, the sizing and shaping of the pin 340B and vertical channel 244B is such that they promote the relatively free insertion and removal of the bracket 300B to the body 242B of the base assembly section 240B.

As shown with particularity in FIG. 5, pin 340B includes a distal end 341B and a proximal end 345B. Both the distal end 341B and the vertical channel 244B define generally cylindrical cross-sectional profiles, although (again, as with the rod 410 and horizontal channel 243B), other sizes and shapes are also within the scope of the present disclosure, so long as they support the selective locking and unlocking of the mounting bracket 300B as discussed herein. In one form, the distal end 341B may terminate in a tapered tip 342B. Although it will be appreciated that such a taper is not required, including it promotes of ease of insertion of the tip 342B into apertures that terminate the vertical channel 244B on an upper surface 245B of the separately-attachable body 242B of base assembly section 240B. A notch 343B is formed between the distal end 341B and the tip 342B. Above the notch 343B, the distal end 341B of the pin 340B defines a generally cylindrical cross section portion 344B in a manner that is sized and shaped to be slidably received within the vertical channel 244B of the body 242B of the base assembly section 240B.

Vertically upward of the pin distal end 341B is a wider region defined by the pin proximal end 345B with flange 346B that can be used to establish a seating area on the upper surface 245B of the separately-attachable body 242B of base assembly section 240B. In addition, the upper portion 347B of pin 340B defines a non-axisymmetric (specifically, rectangular as shown) cross-sectional profile; this profile is such that it forms an adjacently-facing relationship with upward-projecting walls 246B in order to inhibit rotational movement of the bracket 300B once it is seated through pin 340B into the respective base assembly 240B. Thus, a non-axisymmetric seating area about a substantially vertical (that is to say, Z) axis is such that when one of the mounting brackets 300B is placed onto the corresponding base assembly 240B by the operator O, an interference fit formed between the generally vertical upper surface 245B, upward-projecting walls 246B and the adjacent portion of the proximal end 345B of pin 340B substantially prevents rotation of the mounting bracket 300B about a vertical axis of rotation $Z_R$.

Although the notch 343B is presently shown as being circumferential about a lower portion of pin 340B near its distal end 341B, it will be appreciated that other forms of the notch 343B may be used, including stepped cutouts that do not extend around the substantial periphery of the pin 340B, cutouts that extend diametrically all of the way through the pin 340B with a cross-sectional area sufficient to allow the passage of rod 410 therethrough, as well as similarly-sided elongate slots or the like. Furthermore, all of these variants are deemed to be within the scope of the present disclosure.

Referring with particularity to FIGS. 3 and 4, the base assembly 240 is shown with its individual component base assembly sections 240A and 240B in the split configuration (FIG. 3) and support configuration (FIG. 4), where in the former case the two are not in locked arrangement with one another through the locking mechanism 400, while in the latter case they are. As can be seen, the horizontal channels 243A, 243B extend through the rail-engaging supports 241A and 241B and at least far enough into the separately-attachable bodies 242A and 242B in order to reach a common volumetric space 247A, 247B that is formed by the intersection of the horizontal and vertical channels 243A, 244A and 243B, 244B. As such, the mounting brackets 300A, 300B may be placed on the respective base assembly sections 240A and 240B when they are in the split configuration of FIG. 3 in such a way that the distal ends 341 of the pins 340 (of which pin 340B and its distal end 341B as shown in FIG. 5 is representative) are inserted into the respective vertical channels 244 (of which vertical channel 244B as shown in FIGS. 3 through 5 is representative) to form a secure, seated relationship between each mounting bracket 300A, 300B and its corresponding base assembly section 240A, 240B. After this, the base assembly 240 may be moved into its support configuration of FIG. 4 in order to have the rod 410 of the locking mechanism 400 engage the notch 343 (of which notch 343B as shown in FIG. 5 is representative) of the distal end 341B of the pin 340B. As mentioned elsewhere, even though the details associated with the selective engagement and disengagement of the mounting brackets 300 to the base assemblies 240 is described in conjunction with the right-most of the brackets 300B and base assembly sections 240B as depicted in FIGS. 3 and 4, it will be understood that the features mentioned herein also apply equally to the left-most bracket 300A and base assembly component 240A as well.

Although the movement of the base assembly 240 is discussed as being responsive to the drive assembly 200 in general and the operator O—actuated handle 250 in particular, it will be appreciated that such movement may be controlled using an automated feed control system mechanism. In one form, the feed control mechanism may include a computer having logic for controlling operation of one or more transfer motors associated with moving the workpieces. In one form, the computer may be used to control operation of the idle station 1 and transfer presses and their respective motors. Automated operation may take place through control logic, program code or a related algorithm in the form of computer-executable (i.e., machine-readable) instructions that can be performed, run or otherwise conducted on the computer. Such computer-executable instructions may be written in any programming language, including machine language that may be directly executed by a processor as discussed below, assembly language, object-oriented programming (OOP) language, scripting languages, microcode or the like that may be compiled or assembled and stored in memory as discussed below. Alternatively, the machine readable instructions may be written in a hardware description language (HDL), such as logic implemented via either a field-programmable gate array (FPGA) configuration or an application-specific integrated circuit (ASIC), as well as their equivalents. As such, the system and methods described herein may be implemented in any conventional computer programming language, as pre-programmed hardware elements, or as a combination of hardware and software components.

In one form, the computer may be configured to include one or more of an input and output (I/O), a processing unit (often referred to as a central processing unit (CPU) or more generally as a processor) and memory the last of which can temporarily or permanently store such a code, program or algorithm such that the instructions contained in the code are operated upon by the processing unit based on input data received by I/O such that output data generated by the code and the processing unit can be conveyed to another program or a user via I/O. It will be appreciated that instead of a single CPU, the processing unit may be in the form of numerous distributed microprocessors or related processing means, and that either variant is deemed to be within the scope of the present disclosure as long as they are capable of executing the machine-readable versions of the control logic, program code or related algorithm. In one form, a data-containing portion of the memory—also associated with volatile working memory—is referred to as random access memory (RAM), while an instruction-containing portion of the memory—also associated with permanent or non-volatile memory—is referred to as read only memory (ROM). Thus, it will be appreciated by those skilled in the art that computer-executable instructions that embody the calculations discussed elsewhere in this disclosure can be placed within an appropriate location (such as the aforementioned memory) within the computer in order to achieve the objectives set forth in the present invention. In one form, the computer may include additional chipsets (not shown) for peripheral functions. A data bus or related set of wires and associated circuitry forms a suitable data communication path that can act as a local interface or related interconnect for the I/O, processing unit and memory, as well as any peripheral equipment in such a way as to permit the computer to communicate with the idle station 1, transfer press assembly and its associated assemblies, components or related functional modules.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. For example, the system and methods using the system may be implemented in one or both of software and hardware, and that all variations on the embodiments of such system and method as discussed herein will be understood to be within the scope of the present disclosure. Furthermore, the order of steps associated with such methods may be changed, while various features of the system may be combined, added, removed, reordered, modified or the like, and still be within the scope of the present disclosure. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A split idle station for a transfer press assembly, the station comprising:

a track assembly;

a drive assembly cooperative with the track assembly and comprising a base assembly with a plurality of separable sections slidably disposed along the track assembly to move along an elongate dimension thereof between a split configuration and a support configuration, at least one portion of each base assembly section defining:

a vertical channel extending at least partially therein and that terminates in an aperture defined in at least an upper surface thereof; and a horizontal channel extending at least partially therein and that terminates in an aperture defined in at least a side surface thereof, wherein the vertical and horizontal channels intersect to define a common volumetric space thereby;

a plurality of workpiece mounting brackets each of which comprises a pin that extends in a substantially vertical downward direction therefrom such that each mounting bracket is selectively received on a respective one of the base assembly sections through at least the cooperation of the pin and the vertically-extending channel; and a locking mechanism comprising:

a stationary rod secured to the track assembly such that the elongate dimension of the rod is substantially parallel with the track elongate dimension and substantially collinear with the horizontal channel, and a notch formed within the pin, wherein the pin and rod are sized such that the cooperative movement of the base assembly sections toward one another when each of the workpiece mounting brackets is received on the respective one of the base assembly sections causes a portion of the rod to extend into the volumetric space that is occupied by the notch to form an interference fit between the rod and the notch to effect engagement of the locking mechanism, while the cooperative movement of the first and second base assembly sections away from one another causes the rod to release the interference fit from the notch to effect disengagement of the locking mechanism.

2. The station of claim 1, wherein each of the base assembly sections defines an integrally formed body with the horizontal and vertical channels formed therein.

3. The station of claim 1, wherein each of the base assembly sections defines a support and a body fixedly secured thereto and containing the horizontal and vertical channels formed therein.

4. The station of claim 1, wherein a body of each of the base assembly sections that defines the horizontal and vertical channels therein comprises a bracket holder.

5. The station of claim 4, wherein the body further defines a non-axisymmetric seating area about a substantially vertical axis such that when one of the mounting brackets is selectively received within the seating area, an interference fit formed between the seating area and the mounting bracket substantially prevents rotation of the mounting bracket about the vertical axis of rotation.

6. The station of claim 1, wherein when coupled together the movement direction of the handle, base assembly sections and mounting brackets extends along the track assembly elongate dimension between each of the support configuration and the split configuration.

7. The station of claim 1, wherein the handle is secured to one of the base assembly sections such that movement of the secured base assembly by the handle produces sympathetic movement in the other base assembly.

8. The station of claim 1, wherein change between the engagement and disengagement of the locking mechanism is effected solely by movement between the base assembly sections.

9. The station of claim 1, wherein the drive assembly further comprises a handle and a coupling responsive to movement of the handle to provide cooperative movement between the base assembly sections.

10. A transfer press assembly comprising:

a first work station;

a second work station;

a transfer feed assembly that transfers a workpiece from the first work station to the second work station; and a split idle station assembly disposed between the first work station and the second work station, the split idle station assembly comprising:

a track assembly;

a drive assembly cooperative with the track assembly and comprising a plurality of base assembly sections slidably disposed along the track assembly to move along an elongate dimension thereof, at least one portion of each base assembly section defining:

a vertical channel extending at least partially therein and that terminates in an aperture defined in at least an upper surface thereof; and a horizontal channel extending at least partially therein and that terminates in an aperture defined in at least a side surface thereof, wherein the vertical and horizontal channels intersect to define a common volumetric space thereby;

a plurality of workpiece mounting brackets each of which comprises a pin that extends in a substantially vertical downward direction therefrom such that each mounting bracket is selectively received on a respective one of the base assembly sections through at least the cooperation of the pin and the vertically-extending channel; and a locking mechanism comprising:

a stationary rod secured to the track assembly such that the elongate dimension of the rod is substantially parallel with the track elongate dimension and substantially collinear with the horizontal channel, and a notch formed within the pin, wherein the pin and rod are sized such that the cooperative movement of the base assembly sections toward one another when each of the workpiece mounting brackets is received on the respective one of the base assembly sections causes a portion of the rod to extend into the volumetric space that is occupied by the notch to form an interference fit between the rod and the notch to effect engagement of the locking mechanism, while the cooperative movement of the first and second base assembly sections away from one another causes the rod to release the interference fit from the notch to effect disengagement of the locking mechanism.

11. The transfer press assembly of claim 10, wherein the rod defines a substantially cylindrical cross-sectional profile.

12. The transfer press assembly of claim 11, further comprising a coupling that is connected to the base assembly sections such that the cooperative movement of the first and second base assembly sections toward and away from one another is created through the coupling.

13. The transfer press assembly of claim 12, wherein the coupling is actuated by a handle connected thereto.

14. A method of operating an idle station for a transfer press assembly, the method comprising:

arranging the idle station to be adjustable between a support configuration and a split configuration by having a track assembly and a drive assembly comprising a plurality of base assembly sections that are movable between the support configuration and the split configuration;

placing at least one workpiece mounting bracket on a corresponding one of the base assembly sections such that a pin that extends in a substantially vertical downward direction from the mounting bracket is received into a vertical channel that extends into the corresponding one of the base assembly sections; and moving the base assembly sections toward one another along the track assembly such that a locking mechanism engages to secure the mounting bracket to the corresponding one of the base assembly sections solely by such moving; the locking mechanism comprising:

a stationary rod secured to the track assembly and defining an elongate dimension that is substantially parallel with the direction of movement of the base assembly sections along the track assembly such that the elongate dimension of the rod and a horizontal channel that extends at least far enough through the corresponding one of the base assembly sections to define a common volumetric space by its intersection with the vertical channel, and a notch formed within the pin, wherein the pin and rod are sized such that as a result of such moving the base assembly sections toward one another, a portion of the rod extends into the volumetric space that is occupied by the notch to form an interference fit between the rod and the notch.

15. The method of claim 14, wherein moving the base assembly sections comprises at least one of pushing and pulling on a handle that is affixed to at least one of (a) the base assembly sections and (b) a coupling that is responsive to movement of the handle to provide cooperative movement between the base assembly sections.

16. The method of claim 14, wherein the placing at least one workpiece mounting bracket on a corresponding one of the base assembly sections comprises placing a pair of workpiece mounting brackets on a corresponding pair of the base assembly sections.

17. The method of claim 14, further comprising moving the base assembly sections away from one another along the track assembly such that the locking mechanism disengages solely by virtue of such moving away.

18. The method of claim 16, wherein as a result of such moving the base assembly sections away from one another, the portion of the rod that extends into the volumetric space during locking mechanism engagement is released from its interference fit with the notch to effect disengagement of the locking mechanism.

19. The method of claim 14, wherein the placing and removing of the mounting bracket is performed by an operator.

20. The method of claim 19, wherein the operator performs the placing and removing of the mounting bracket with one hand.

* * * * *